US006000994A

United States Patent [19]

Salotto

[11] Patent Number: 6,000,994

[45] Date of Patent: Dec. 14, 1999

[54] METHOD FOR MAKING BRAS AND THE LIKE

[76] Inventor: Luciano Salotto, c/o Saltek S.r.l. Via Dell'Agricoltura, 9/15, 20083 Vigano di Gaggiano (Milano), Italy

[21] Appl. No.: 09/003,232

[22] Filed: Jan. 6, 1998

[30] Foreign Application Priority Data

Jan. 13, 1997 [IT] Italy ..... MI97A0044

[51] Int. Cl.[6] ..... A41C 3/00

[52] U.S. Cl. ..... 450/92; 450/1; 2/243.1

[58] Field of Search ..... 2/243.1, 69; 450/92.1

[56] References Cited

U.S. PATENT DOCUMENTS 5,553,468 9/1996 Osborne ..... 450/92 X 5,605,060 2/1997 Osborne ..... 450/92 X 5,907,872 6/1999 Alberts et al. ..... 450/92 X

*Primary Examiner*—Gloria M. Hale

*Attorney, Agent, or Firm*—Bucknam and Archer

[57] ABSTRACT

The present invention relates to a method for making bras and the like, comprising the steps of die-cutting a fabric for making a die-cut fabric element defining a bottom band, to which are coupled contoured portions defining the breast cups, applying resins on a region of the bottom band, on a side of a symmetry line and at edge regions of the contoured portions, folding the die-cut element along the symmetry line so as to cover the resin coated regions, reacting the coated resin, and applying to the bra shoulder straps and closing elements.

9 Claims, 4 Drawing Sheets

METHOD FOR MAKING BRAS AND THE LIKE

BACKGROUND OF THE INVENTION

The present invention relates to a method for making bras and the like.

As is known, prior methods for making bras conventionally comprise a plurality of operating steps in which the component parts of the bra are cut and then assembled by very complex seaming operations.

Moreover, during the seaming operation, reinforcement elements, such as metal wire reinforcement elements, are conventionally arranged at the breast cup of the bra.

Thus, it should be apparent that the mentioned prior method is a very expensive one, since it requires a lot of expensive manual operations.

Another drawback affecting the above mentioned prior method is that the above mentioned metal reinforcement elements can be easily disengaged from the bra fabric material and, moreover, they can easily become rusty, thereby unaesthetically staining the bra.

SUMMARY OF THE INVENTION

Accordingly, the aim of the present invention is to overcome the above mentioned drawbacks, by providing a method for making bras and the like substantially omitting all of the seaming steps of the bra portions, while using fully automatic making apparatus, with a very reduced labour use.

Within the scope of the above mentioned aim, a main object of the present invention is to provide such a bra making method which does not use, for reinforcement purposes, any metal reinforcement elements.

Another object of the present invention is to provide such a bra making method which is very reliable and safe in operation.

Yet another object of the present invention is to provide such a bra making method which allows to quickly and easily make a lot of different patterns of bras, starting from easily available elements and materials and which, moreover, is very competitive from a mere economic standpoint.

According to one aspect of the present invention, the above mentioned aim and objects, as well as yet other objects, which will become more apparent hereinafter, are achieved by a method for making bras and the like, characterized in that said method comprises the steps of die-cutting a fabric material to provide a die-cut fabric element comprising a bottom band to which are coupled contoured portions defining breast cups, applying reinforcement elements on a region of said bottom band on a side of a symmetry line and at edge regions of said contoured portions, folding said fabric die-cut element along said symmetry line in order to cover the resin coated regions, causing said resin to react and applying to the thus made bra shoulder straps and closing elements.

BRIEF DESCRIPTION OF THE DRAWINGS

Further characteristics and advantages of the present invention will become more apparent from the following detailed disclosure of a method for making bras and the like, according to the present invention, and as shown, by way of an indicative, but not limitative, example, in the accompanying drawings, where.

DESCRIPTION OF THE PREFERRED EMBODIMENT

Figure 1:
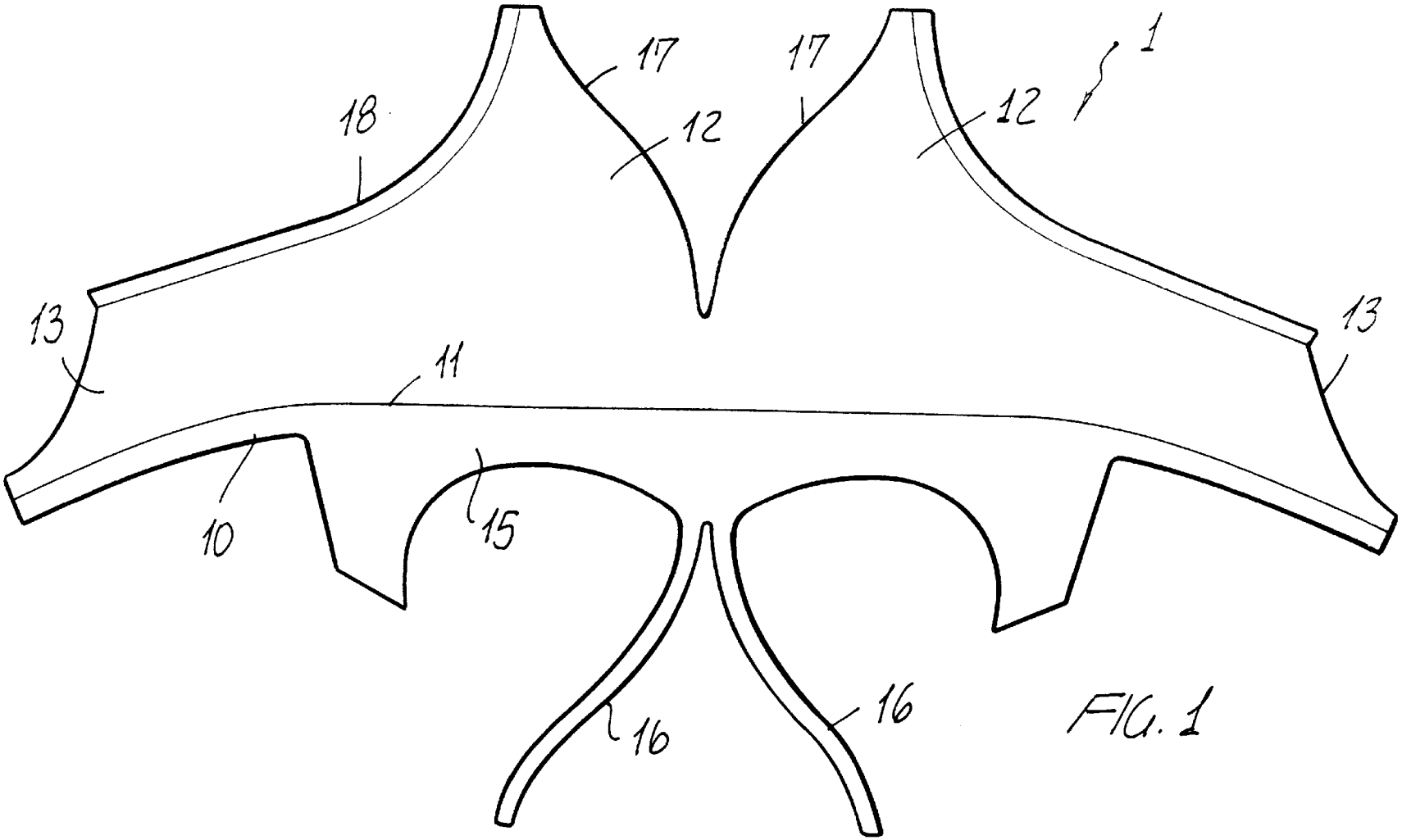
FIG. 1 is a schematic view illustrating the starting fabric die-cut element for making the subject bra.
Figure 2:
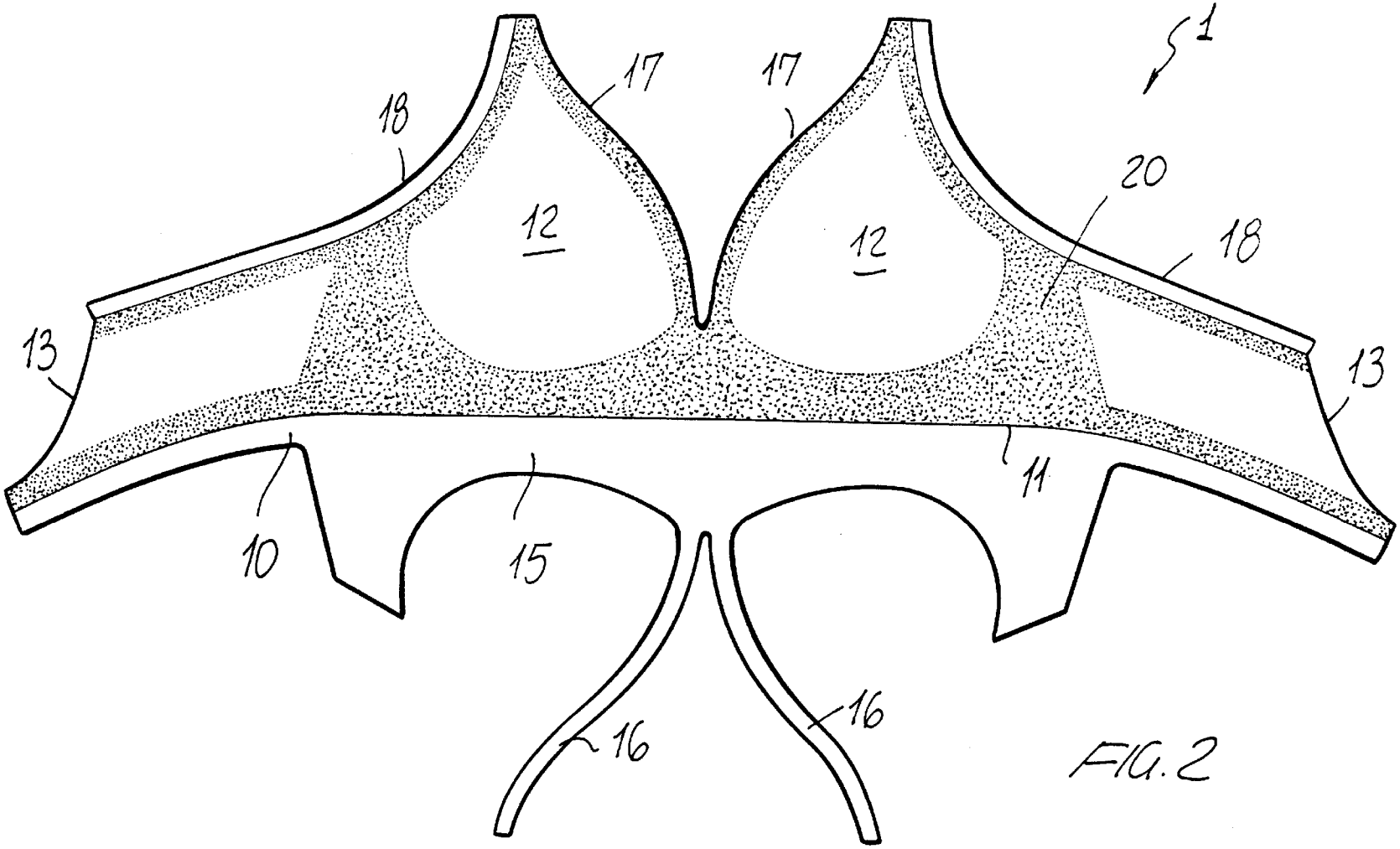
FIG. 2 illustrates the fabric die-cut element and regions thereof to be coated by a suitable resin.

With reference to the number references of the above mentioned figures, the method for making bras and the like, according to the present invention, comprises a step of die-cutting a fabric material, to provide a fabric die-cut element, generally indicated by the reference number 1.

The die-cut element, in particular, is preferably made of a slightly elasticized fabric, perfectly fitting to the contours of a woman body.

The die-cut element comprises a bottom band 10, adjoining a symmetry and folding line 11.

The die-cut element 1 comprises moreover contoured portions 12, defining the breast cups, which are coupled to side extended portions 13, provided for making, as it will be disclosed in a more detailed manner hereinafter, the rear portion of the bra.

At the above mentioned bottom band a under-cup region 15 is provided, said region being arranged near web elements 16 which can be arranged onto one another at the central edges 17 of the bra.

Moreover, the bra is provided with top side edges 18 practically connecting the region of the breast cups 12 with the side extended portion or lug 13.

In a further step of the method, on the above mentioned die-cut element suitable resin materials will be applied, generally indicated by the reference number 20, said resin materials including plastic resins operating as thermal glues for providing a stable connection upon folding the die-cut element along the symmetry line 11.

In particular, the overlapped fabric portions of the under-cup portions will provide a supporting region, adjoining the bottom of the breast cups, whereas the web 16, being overlapped on the edge 17, will provide a finishing and delimiting element operating as a breast cup delimiting and containment element.

Likewise, the side edge 18 will be folded so as to provide a finishing and reinforcement line at the side edges.

As mentioned, the used resins may have a simple thermoglueing function.

However, epoxy resins and the like can be further applied, which, after a thermal reaction or upon applying a suitable catalyst, will provide a stiffening and reinforcement element.

Thus, it will be possible to omit the use of any metal reinforcement elements or inserts.

Figure 3:
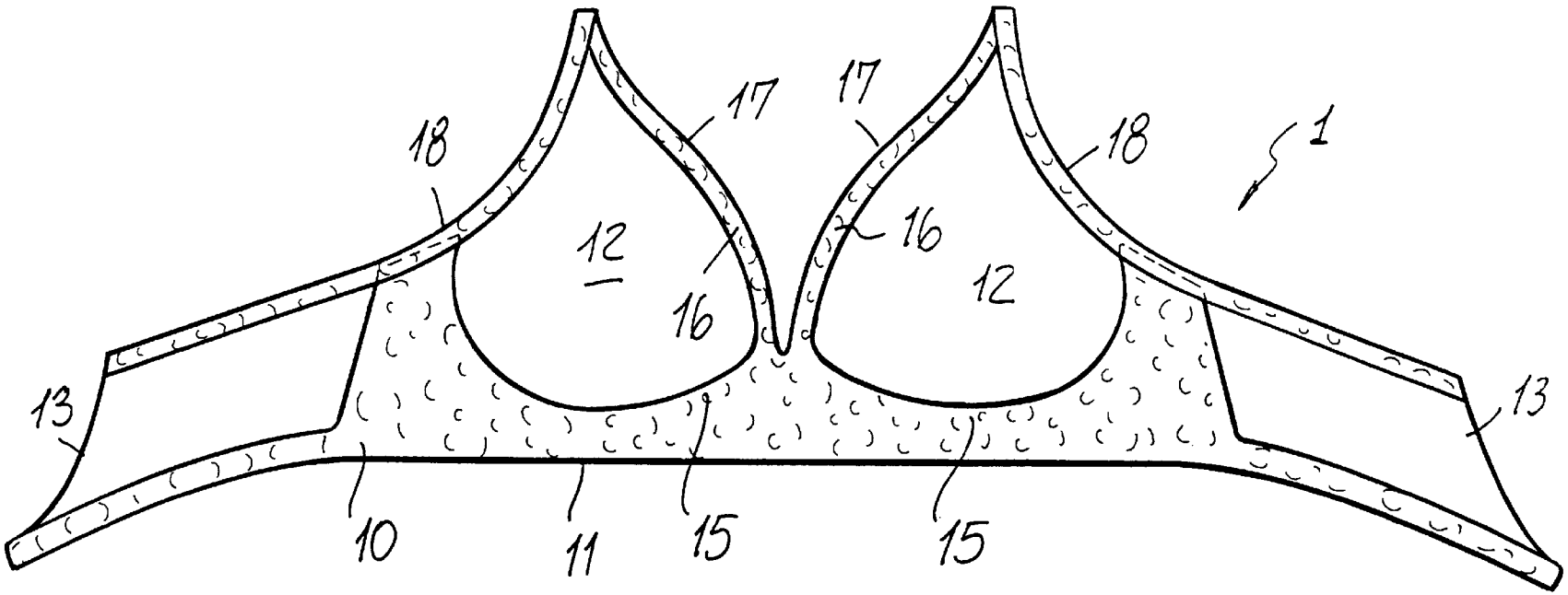
FIG. 3 illustrates a folding step for covering the resin coated regions of the bra.
Figure 4:
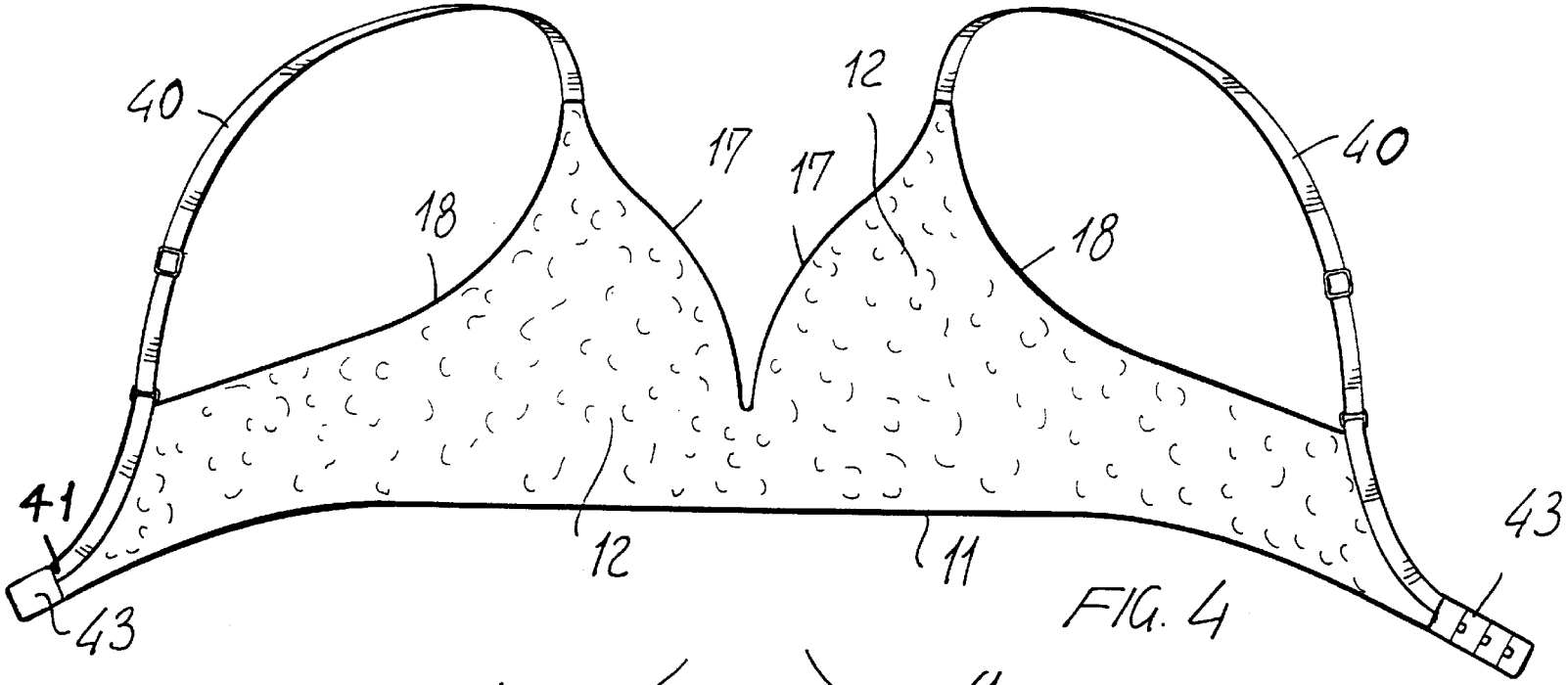
FIG. 4 illustrates the bra in a fully completed condition.
Figure 5:
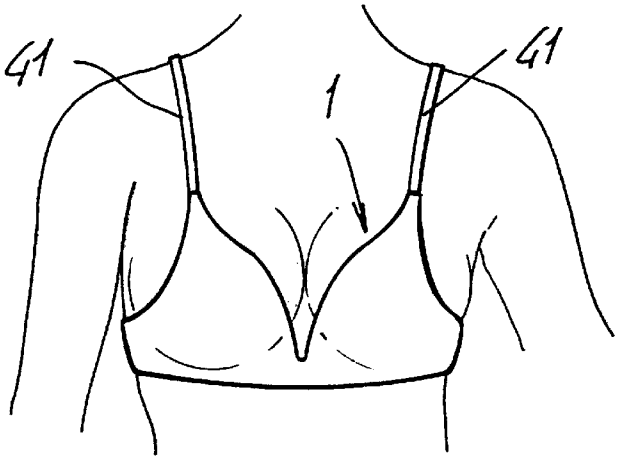
FIG. 5 illustrates the bra according to the present invention in a worn condition.

After the thermal reaction of the resins, and after having made the article of manufacture indicated by the reference number 30 in FIG. 3, shoulder elements will be applied, by using resilient straps and the like, as indicated by the reference number 40, said shoulder elements being coupled to an overlapping portion 41 affecting the mentioned extended portions or lugs.

At the free edges of the mentioned lugs 13, moreover, closure elements, generally indicated by the reference number 43, will be applied, said closure elements conventionally including hook and loop elements, Velcro elements or other elements allowing to easily connect the end portions.

From the above disclosure it should be apparent that the invention fully achieves the intended aim and objects.

In particular, the fact is to be pointed out that a method for making bras has been provided, which does not include any seaming steps and which allows to properly pattern the bra supporting and reinforcement regions, by using plastic resins which can be easily applied by spreading, spraying and the like.

The type and fitness of said resins, in particular, can be easily changed in order to provide different reinforcement and stiffness properties to the made bra.

The invention, as disclosed, is susceptible to several modifications and variations, all of which will come within the scope of the invention.

Moreover, all of the details, can be replaced by other technically equivalent elements.

In practicing the invention, the used materials, provided that they are compatible to the intended application, as well as the contingent size and shapes, can be any, depending on requirements.

I claim:

1. A method of making bras, wherein said method comprises the steps of 1) of die-cutting a fabric material to provide a die-cut fabric element comprising a bottom band to which are coupled contoured portions defining breast cups, 2) coating preset regions of said die-cut fabric element, with a plastic resin, 3) applying reinforcement elements on a region of said bottom band on a side of a symmetry line and at edge regions of said contoured portions, 4) folding said die-cut fabric element along said symmetry line in order to cover said preset resin coated regions thereof, 5) causing said plastic resin to react and 6) applying to the thus made bra shoulder straps and closing elements.

2. The method according to claim 1, wherein said die-cut element defines, at said bottom band, an under-cup portion adjoining web elements overlapping central edge portions of the die-cut element, and top side edges connected to side lugs.

3. The method according to claim 2, wherein said resin is applied on said central edges and top side edges of said die-cut element, said web elements overlapping said central edges and said top side edges being folded.

4. The method according to claim 1, wherein said fabric is an elasticized fabric.

5. The method according to claim 1, wherein said resin is a thermally glueing resin.

6. The method according to claim 1, wherein said resin is a reinforcement and stiffening resin.

7. The method according to claim 1, wherein said resin is applied by a spreading process.

8. The method according to claim 2, wherein said method further comprises the step of applying a reinforcement web element to said side lugs.

9. The method according to claim 1, wherein said closing elements are coupled to said side lugs.

* * * * *